US007270035B2

(12) United States Patent
Lu

(10) Patent No.: US 7,270,035 B2
(45) **Date of Patent: *Sep. 18, 2007**

(54) SINGLE-WEDGE WRENCHES

(76) Inventor: Hong Lu, Room 11E, Building E, Huatingjiayuan No. 6 Beisihuanzhonglu, Chaoyang District, Beijing (CN) 100029

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 10/533,647

(22) PCT Filed: Oct. 31, 2003

(86) PCT No.: PCT/CN03/00926

§ 371 (c)(1),
(2), (4) Date: Nov. 29, 2005

(87) PCT Pub. No.: WO2004/041480

PCT Pub. Date: May 21, 2004

(65) Prior Publication Data

US 2006/0137496 A1 Jun. 29, 2006

(30) Foreign Application Priority Data

Nov. 5, 2002 (CN) ..... 02 2 70676

(51) Int. Cl.
*B25B 13/16* (2006.01)

(52) U.S. Cl. ..... 81/179

(58) Field of Classification Search ..... 81/179, 81/165, 170

See application file for complete search history.

(56) References Cited

U.S. PATENT DOCUMENTS

| | | | | |
|---|---|---|---|---|
| 2,983,173 | A * | 5/1961 | Buxton, Jr. | 81/179 |
| 3,901,107 | A | 8/1975 | Halls | 81/170 |
| 4,437,364 | A * | 3/1984 | Martinmaas | 81/179 |
| 4,706,528 | A | 11/1987 | Inoue | 81/179 |
| 4,813,309 | A | 3/1989 | Kang | 81/57.43 |
| 2003/0183048 | A1 * | 10/2003 | Olsen | 81/179 |
| 2004/0031359 | A1 * | 2/2004 | Kady | 81/179 |

FOREIGN PATENT DOCUMENTS

| | | | |
|---|---|---|---|
| CN | 86204867 | U | 4/1987 |
| CN | 2069335 | U | 1/1991 |
| CN | 2139873 | Y | 8/1993 |
| CN | 1025300 | C | 7/1994 |
| CN | 2243367 | Y | 12/1996 |
| CN | 1227780 | A | 9/1999 |

* cited by examiner

*Primary Examiner*—Jacob K. Ackun, Jr.
(74) *Attorney, Agent, or Firm*—Seed IP Law Group PLLC

(57) ABSTRACT

Disclosed is a single wedge wrench including two jaws, one of which has a zigzag gripping surface. The wrench further includes a wedge having a zigzag gripping surface. The wedge is mounted on an inner surface of the other one of the two jaws by means of a joint member, being slidable along the inner surface. The wrench disclosed can be used for bolts or nuts with various types and sizes, and an operation can be performed as long as a handle of the wrench is returned. The wrench can be manufactured with a simple process in a production line.

5 Claims, 8 Drawing Sheets

SINGLE-WEDGE WRENCHES

BACKGROUND OF THE INVENTION

1. Field of the Invention

The present invention relates to a hand tool, and more particularly to a wrench having a jaw with a wedge.

2. Description of the Prior Art

There have been two kinds of wrenches in the art. One is an adjustable wrench and the other is a solid wrench. The wrench in the art comprises a handle and a jaw. Gripping surfaces of the jaw are typically flat and face each other in parallel. Such conventional wrenches have the following disadvantages in gripping and rotating an object such as a pipe or a nut: (1) The gripping surfaces of the jaw are liable to slip along a surface of the object; (2) When the wrench works in a limited space, the wrench must be adjusted to reengage the object frequently, which decreases the efficiency; and (3) The edge of the object is likely to be damaged by a force directly applied thereto by the wrench.

In order to solve the problems of the gripping force of the conventional wrench as mentioned above, a wedge-type wrench is disclosed by Chinese Utility Model No. 9210556.7. The wrench has two jaws, each having a gripping surface. A sliding hole is provided at the each gripping surface. A cylindrical wedge connected to a spring is disposed within the sliding hole. Two teeth working surfaces of the wedges are disposed opposite each other. When used to turn a nut, the two wedges can engage the nut tightly to increase the friction and enhance the gripping force. The wrench can be adjusted to a proper position by simply turning itself to make each wedge sliding within the respective sliding hole. Thus, the wrench can successively work without a repeated operation of releasing and reengaging the nut, thereby improving the working efficiency.

However, such a wrench has some drawbacks. (1) It cannot be used for a small size object, because when the front ends of the two gripping surfaces, each configured in an arc shape, contact each other, there is a gap between the rear ends thereof. (2) Since the wedge is directly fixed in the sliding hole by a locating pin, the pin is easily damaged by a force the object exerts on the wedge during the operation. (3) As the wedge is of a cylindrical configuration, when the thickness of an object is less than half of that of the wedge, the wedge will not firmly clamp the object due to an uneven gripping force. (4) The production of the wrench requires a complex process. Two sliding holes, of which the centerline is perpendicular to each other, are to be provided in the jaws to receive the wedges and springs.

BRIEF SUMMARY OF THE INVENTION

To overcome the shortcomings in the prior art as described above, the present invention provides a single-wedge wrench, which does not need to frequently adjust the position of disengaging and reengaging an object such as a nut, can apply a relatively larger torque of rotation to the object, and is of a simple manufacturing process.

According to the invention, there is provided a single wedge wrench comprising two jaws, one of which has a zigzag gripping surface, characterized in that the wrench further comprises a wedge having a zigzag gripping surface, which is mounted through a joint member on an inner surface of the other jaw of the two jaws, and is slidable along the inner surface.

According to an embodiment of the present invention, a guiding rail is configured in either the jaw or the wedge. A groove is formed in the guiding rail, and a spring is positioned at a bottom portion of the groove along a longitudinal direction. The other of either the jaw or the wedge is provided with a guiding slot corresponding to the guiding rail and a blind hole communicating with the guiding slot. The joint member is an L-shaped member, of which a section is placed in the groove of the wedge and connected to the spring, and another section is located within the blind hole of the jaw. A limitation element is provided in the blind hole so as to confine the movement of the joint member.

According to the present invention, the jaw on which the wedge is mounted can be either an adjustable jaw or a stationary jaw. In addition, an angle ranging from 10 degrees to 70 degrees is formed between the inner surface of the jaw on which the wedge is mounted and the gripping surface of the other jaw.

According to the invention, by providing a wedge slidable along the gripping surfaces of one of the jaws, a gap or space between two gripping surfaces can be adjusted so that the wrench can turn an object without repeatedly disengaging and reengaging the object. Meanwhile, when a turning force is applied to the object, a counterforce generated from the object to the wedge can make the wedge positioned at the jaw, which tightens or loosens the object in cooperation with the other jaw. The wrench of the invention provides the following advantages:

(1) The wrench of the present invention can be used for bolts or nuts of various types and sizes. The wedge can tightly engage a bolt or nut during operation. When the wrench needs to be adjusted to a proper position during operation, it can be reached by simply returning a handle of the wrench without loosing the bolt or nut, whereupon the bolt or nut can be clamped again. Furthermore, the invention realizes a surface contact of the wrench with the bolt or nut instead of a line contact in the prior art, which prevents the bolt or nut from being damaged.

(2) A relatively large torque can be applied by the jaw according to the invention so that the operation can be performed more conveniently. Furthermore, when a position of the wedge relative to the sliding hole changes upon a change of the size of the object, the turning force can be transferred through the wedge no matter what position it is, thereby preventing the wedge from being damaged.

(3) The wrench of the present invention can be manufactured with a simple process in a production line.

DETAILED DESCRIPTION OF THE PREFERRED EMBODIMENTS

With reference to the drawings, the preferred embodiments of the present invention will be further described as follows.

Figure 1:
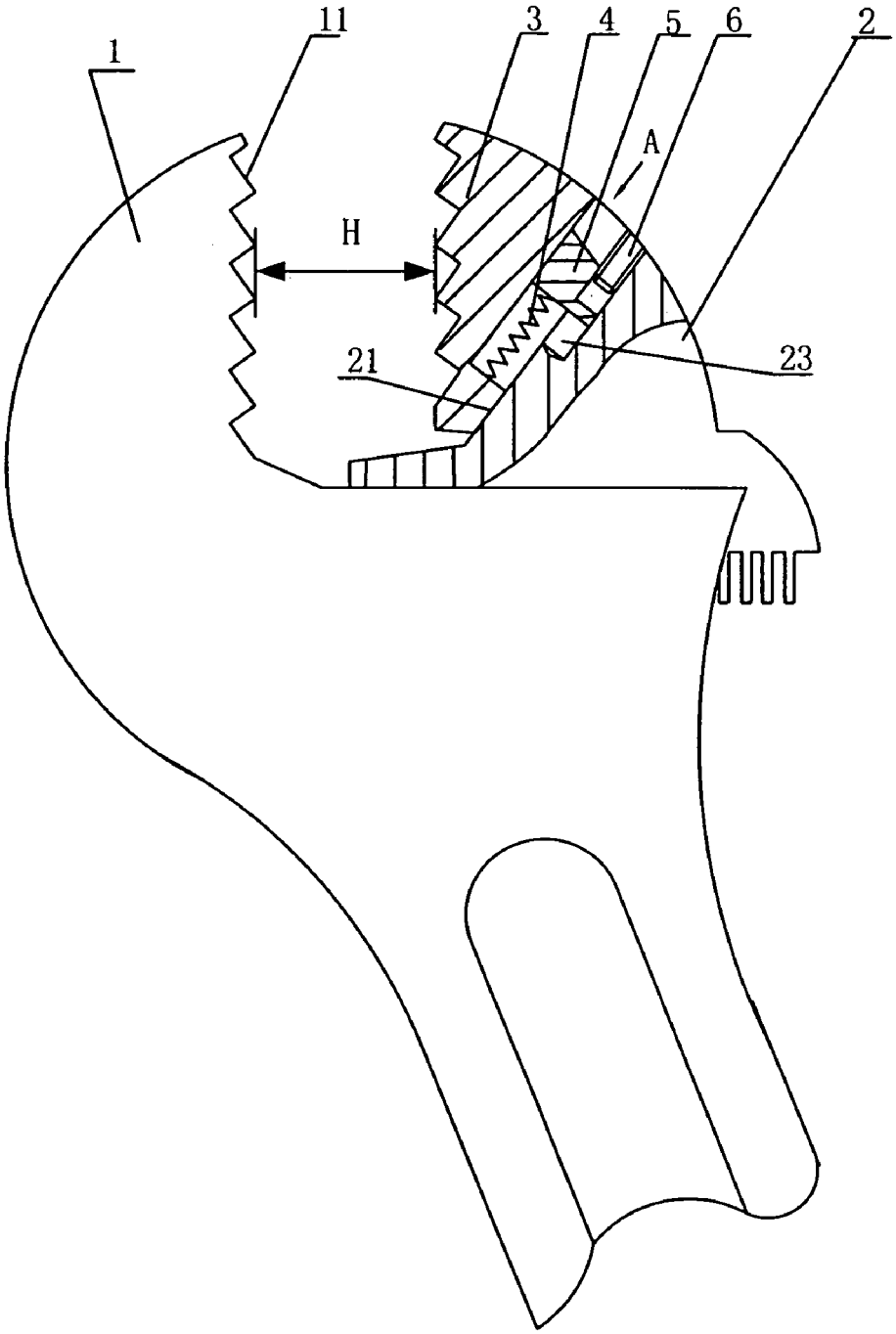
FIG. 1 is a schematic view showing the structure of an adjustable wrench according to one embodiment of the present invention.
Figure 2:
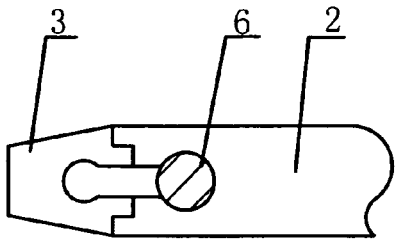
FIG. 2 is a schematic view taken from the direction of A shown in FIG. 1.
Figure 3:
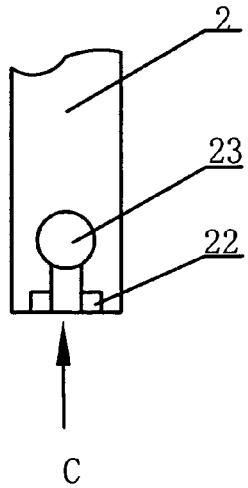
FIG. 3 is a top view of an adjustable jaw 2 shown in FIG. 2.
Figure 4:
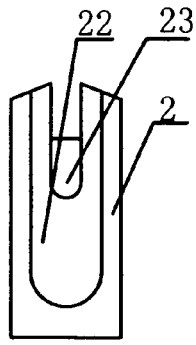
FIG. 4 is a schematic sectional view taken from the direction of C shown in FIG. 3.

FIGS. 1 to 8 show a wrench according to a first preferred embodiment of the present invention. As shown in FIG. 1, a head portion of the wrench of the preferred embodiment has a stationary jaw 1 and an adjustable jaw 2. A zigzag gripping surface 11 is provided at the stationary jaw 1. Referring to FIG. 3 and FIG. 4 also, a guiding slot 22 and a blind hole 23 communicated with the guiding slot 22 are provided at an inner surface 21 of the adjustable jaw 2 opposite to the stationary jaw 1.

Figure 5:
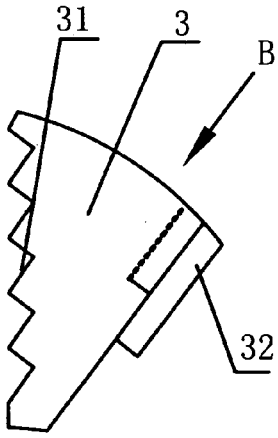
FIG. 5 is a schematic view showing the structure of a wedge 3 shown in FIG. 2.
Figure 6:
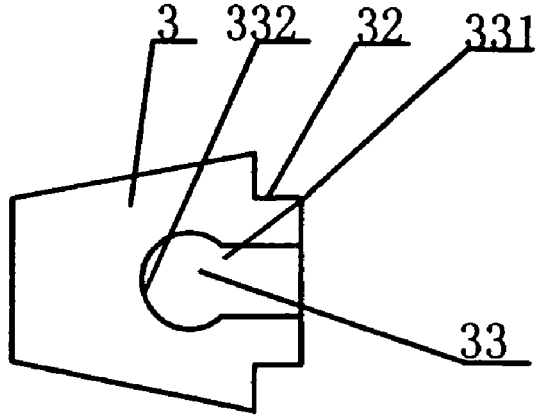
FIG. 6 is a schematic view taken from the direction of B shown in FIG. 5.

As shown in FIG. 2, FIG. 5 and FIG. 6, the wrench of the first preferred embodiment of the present invention further comprises a wedge 3, which is mounted on the adjustable jaw 2, provides a zigzag gripping surface 31. A guiding rail 32 is configured at a surface of the wedge 3, which matches the inner surface 21 of the adjustable jaw 2. The guiding rail 32 matches the guiding slot 22 of the adjustable jaw 2, and can slide within the guiding slot 22.

As shown in FIG. 1 and FIG. 6, a groove 33 is provided in the guiding rail 32. An open portion 331 of the groove 33 is rectangular, while a bottom portion 332 of the groove 33 is circular. The diameter of the bottom portion 332 of the groove 33 is larger than the width of the open portion 331 of the groove 33. A spring 4 is installed within the groove 33 along the longitudinal direction of the bottom portion 332.

Figure 7:
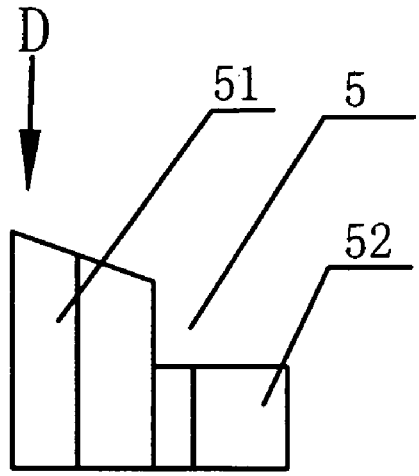
FIG. 7 is a schematic view of an L-shaped joint member 5 shown in FIG. 1.
Figure 8:
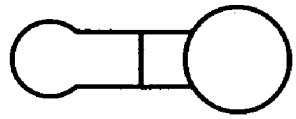
FIG. 8 is a schematic view taken from the direction of D shown in FIG. 7.

As shown in FIG. 1, FIG. 7 and FIG. 8, a section 51 of an L-shaped joint member 5 is installed in the groove 33, and connected to the spring 4 placed in the groove 33. Another section 52 of the L-shaped joint member 5 is mounted in the blind hole 23 of the adjustable jaw 2. A thread (not shown) is provided at an open portion of the blind hole 23 so that a bolt 6 can be screwed therein. The bolt 6 functions to limit the movement of the section 52 of the L-shaped joint member 5 in the blind hole 23. The bolt 6 can be substituted by other components. For example, a rivet can be embedded into the blind hole 23.

In operation, when the wrench grips and rotates an object, the wedge 3 is slidable along the inner surface 21 of the adjustable jaw 2, and thereby continuously adjusts the position by itself to grip the object. When the wrench is needed to be turned back to reengage the object in a limited space, a handle of the wrench is rotated to a desired position in the counterclockwise direction. Because the inner surface 21 of the adjustable jaw 2 is inclined at a sharp angle relative to the gripping surface 11 of the stationary jaw 1, when the handle is rotated in the anticlockwise direction, the wedge 3 can slide along the inner surface 21 of the adjustable jaw 2, and the distance "H" between the gripping surface 11 of the stationary jaw 1 and the gripping surface of the wedge 3 can be continuously adjusted without rotating the object. The object can then be clamped and rotated again by further rotating the handle in the clockwise direction. Repeating this operation can tighten the object.

Moreover, since the wrench of the present invention has the structure as described above, the object can be held easily due to the zigzag configuration of the wedge 3 and the stationary jaw 1 without damaging the edge of the object (bolt or nut). On the other hand, when the object is tightened, the force applied to the wedge 3 can be delivered in parallel to the adjustable jaw 2 and the handle of the wrench, so that the wrench can have a relatively large torque without affecting the wedge itself. These are also the advantages of the present invention over the prior art.

Furthermore, for the wrench of the present invention, because one of the gripping surfaces of the wrench is fixed, while the wedge is connected to the jaw in a right angle, the problem of rotating distortion existing in the wrench disclosed by Chinese Utility Model Patent No. 9210556.7 can be avoided, even if the thickness of the object is less than half of that of the wedge.

FIGS. 9 to 13 show another preferred embodiment of the present invention. In this preferred embodiment, an alternative matching structure between the adjustable jaw 2 and the wedge 3 is configured to achieve the purpose that the wedge 3 can slide along the adjustable jaw 2.

As shown from FIGS. 9 to 13, a zigzag gripping surface 31 is formed on the wedge 3. A guiding slot 34 and a blind hole 35 communicated with the guiding slot 34 are formed in the surface of the wedge 3 which matches the inner surface 21 of the adjustable jaw 2. A guiding rail 24 and a groove 25 are formed in the inner surface 21 of the adjustable jaw 2. An open portion 251 of the groove 25 is rectangular and a bottom portion 252 of the groove 25 is circular. The diameter of the bottom portion 252 is larger than the width of the open portion 251 of the groove 25. A spring 4 is disposed within the groove 25 along the longitudinal direction of the bottom portion 252.

Figure 9:
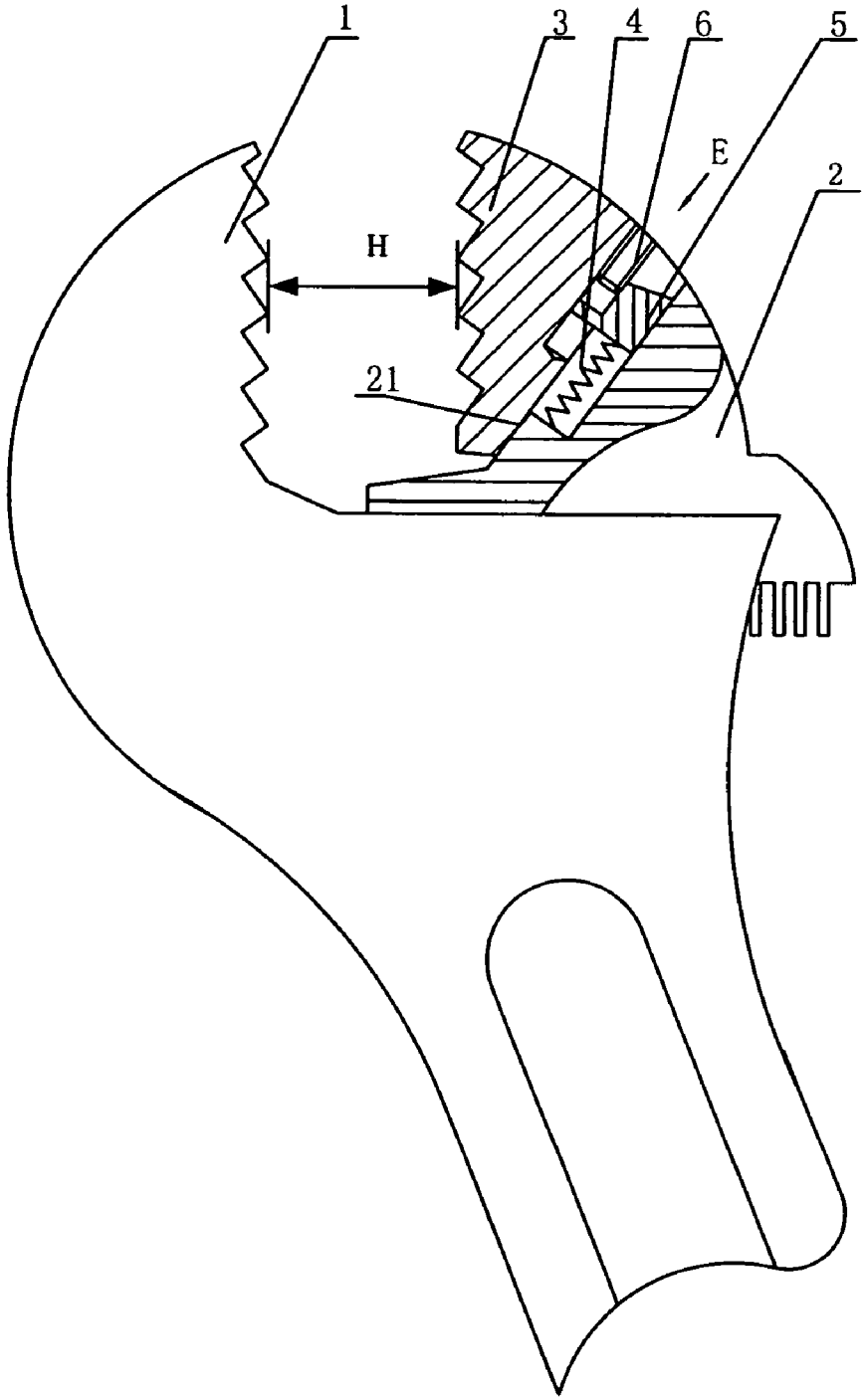
FIG. 9 is a schematic view of another embodiment according to the present invention.
Figure 10:
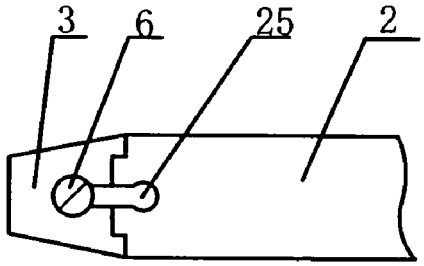
FIG. 10 is a schematic view taken from the direction of E shown in FIG. 9.
Figure 11:
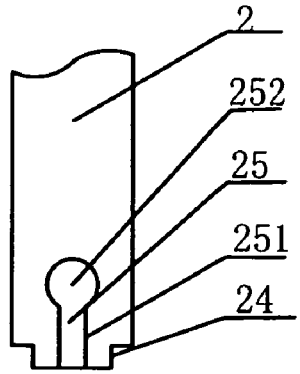
FIG. 11 is a top plan view of the adjustable jaw 2 shown in FIG. 10.
Figure 12:
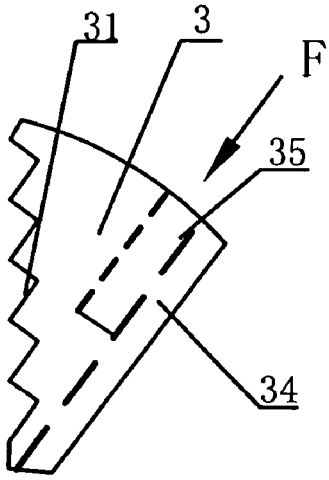
FIG. 12 is a schematic view of a wedge 3 shown in FIG. 10.
Figure 13:
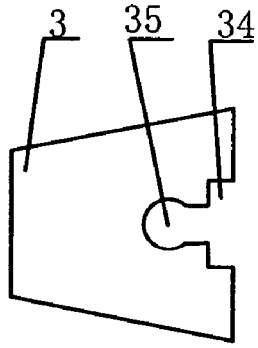
FIG. 13 is a schematic view viewed along the direction of F shown in FIG. 12.

Referring to FIG. 9 in connection with FIG. 7 and FIG. 8, the section 51 of the L-shaped joint member 5 is installed in the groove 25, and connects the spring 4 placed in the groove 25. The other section 52 of the L-shaped joint member 5 is mounted in the blind hole 35 of the adjustable jaw 2. A thread (not shown) is provided at an open portion of the blind hole 35, so that the bolt 6 can be screwed into the blind hole. The bolt 6 limits the movement of the side section 52 of the L-shaped joint member 5 in the blind hole 35. The bolt 6 can be substituted by a rivet or the like.

The wrench having the structure as mentioned above can realize the same functions as the first preferred embodiment.

FIGS. 14 to 18 show a further embodiment of the present invention.

Figure 14:
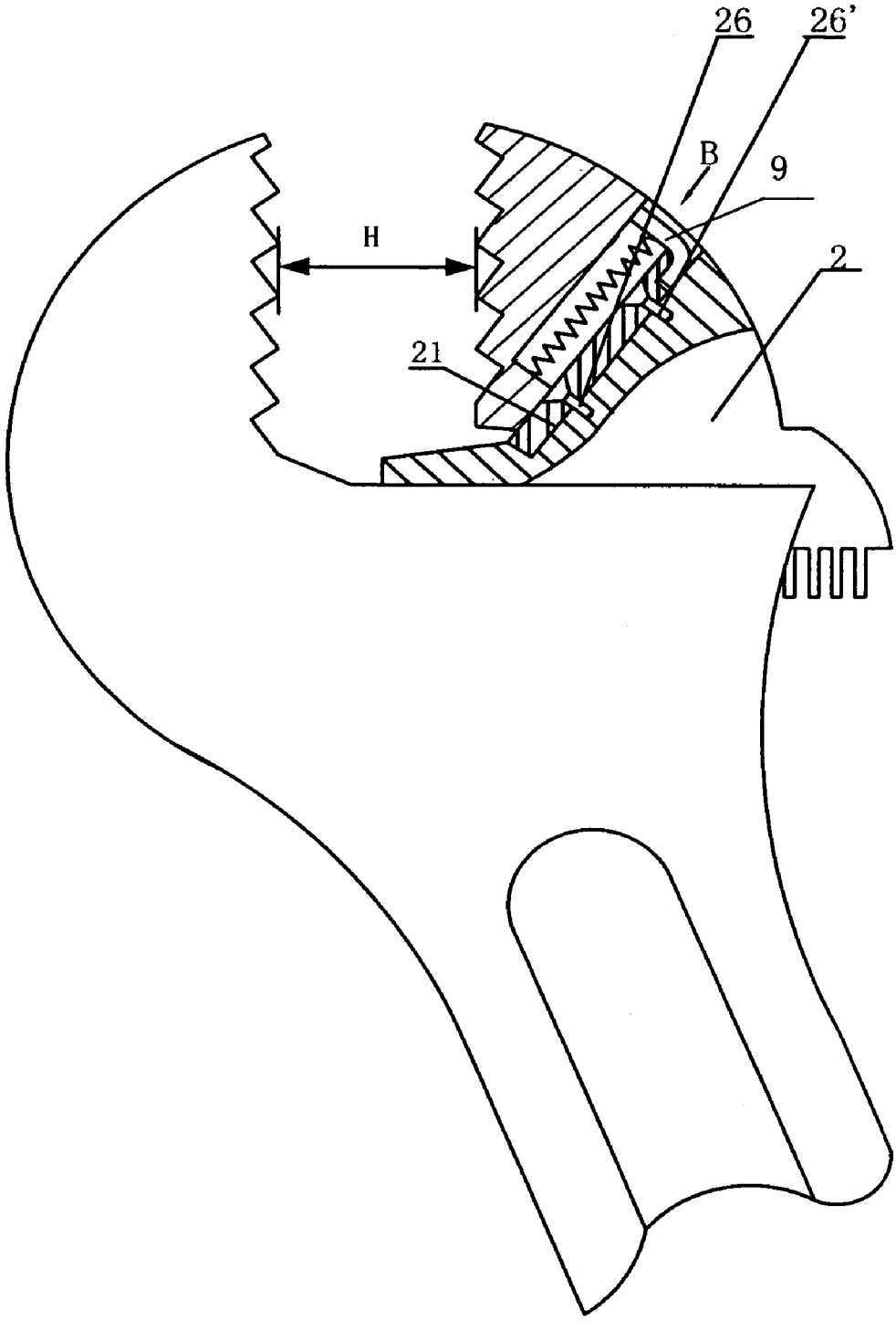
FIG. 14 is a schematic view of another embodiment according to the present invention.
Figure 15:
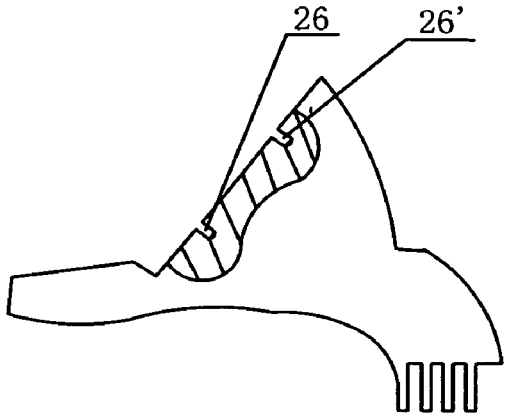
FIG. 15 is a partial sectional view of an adjustable jaw shown in FIG. 14.
Figure 16A:
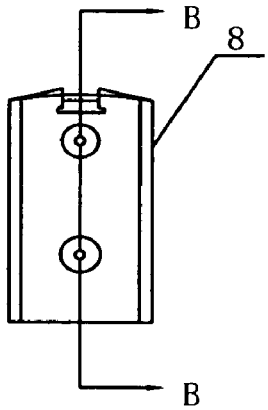
FIG. 16A is a front view of a joint member shown in FIG. 14.
Figure 16B:
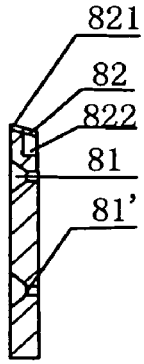
FIG. 16B is a sectional view taken from the direction of B-B shown in FIG. 16A.

As shown in FIG. 14, in the present embodiment, a fixed joint member 8 is provided between the wedge 3 and the adjustable jaw 2. As shown in FIG. 15, two screw holes 26 and 26' are formed at the inner surface 21 of the adjustable jaw 2 (perpendicular to the inner surface 21). As shown in FIG. 16A and FIG. 16B, two apertures 81 and 81' each having a trapeziform cross-section are formed in the fixed joint member 8 corresponding to the screw holes 26 and 26'. The fixed joint member 8 can be secured on the inner surface 21 by two bolts with their heads corresponding to that of the apertures 81 and 81'. An L-shaped groove 82 is formed at one end portion of the joint member. A plate 9 is installed in the groove 82.

As shown in FIGS. 16A, 16B, 17A and 17B, the shape of the plate 9 and that of the groove 82 are configured to match each other. An upper portion 91 of the plate 9 is embedded into an upper portion 821 of the groove 82, and a lower portion 92 of the plate 9 is embedded into a lower portion 822 of the groove 82.

Figure 18A:
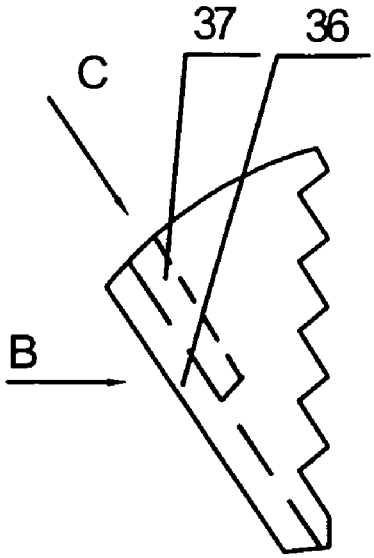
FIGS. 18A-18C are a side view, a schematic view taken from the direction of B, and a schematic view taken from the direction of C, respectively, of a wedge in FIG. 14.
Figure 18B:
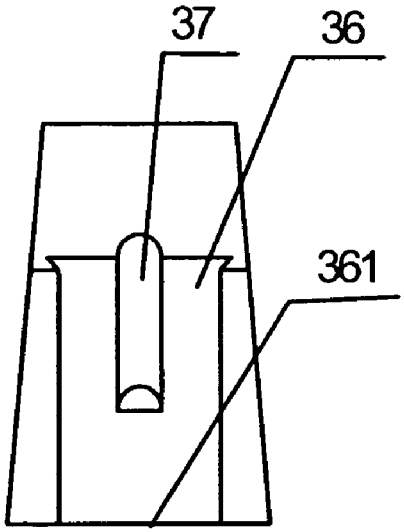
Figure 18C:
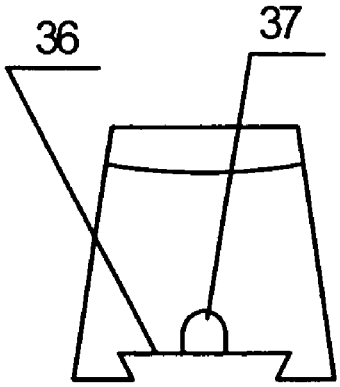

The structure of the wedge 3 in this embodiment is shown in FIGS. 18A to 18C. An inverted trapeziform sliding slot 36 is formed (as shown in FIG. 18B and FIG. 18C) at a mounting surface of the wedge 3. The sliding slot 36 and the fixed joint member 8 are configured to match each other, so that the fixed joint member 8 can be embedded into the sliding slot 36, and the sliding slot 36 can slide along the fixed joint member 8. A recess 37 is formed at the bottom of the sliding slot 36, and the spring 4 is placed in the recess 37. The length of the spring 4 is approximately equal to that of the recess 37.

Figure 17A:
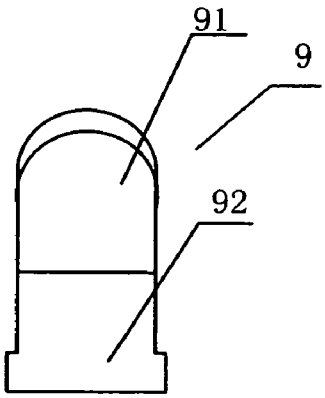
FIGS. 17A and 17B are a schematic front view and a side view of a plate shown in FIG. 14, respectively.
Figure 17B:
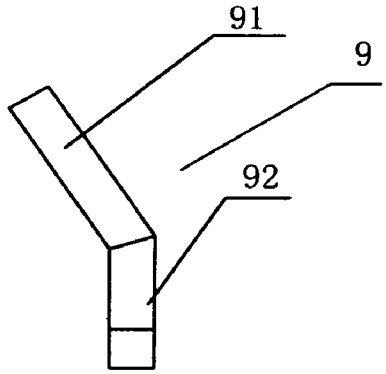

Firstly, to mount the wedge 3 onto the adjustable jaw 2, the plate 9 is placed into the L-shaped groove 82 of the fixed joint member 8. At this time, the angle between the upper portion 91 and the lower portion 92 of the plate 9 is larger (as shown in FIG. 17B), so that the insertion of the fixed joint member 8 into the recess 37 of the wedge 3 is not hindered. Then, the joint member 8 is fastened onto the inner surface 21 of the adjustable jaw 2 by means of two bolts (not shown). Next, one end 361 of the sliding slot 36 of the wedge 3 is aligned with the joint member 8 and then the sliding slot 36 slides along the joint member 8 so that the joint member 8 is embedded into the sliding slot 36. The spring 4 is then put into the recess 37. Finally, as shown in FIG. 14, the upper portion 91 of the plate 9 is pressed to cover the sliding slot 36 and the recess 37 of the wedge 3. In this way, the assembly of the wrench with a wedge according to this embodiment of the present invention is implemented.

In the embodiments mentioned above, the inner surface 21 of the adjustable jaw 2 and the gripping surface of the stationary jaw 1 can form an angle ranged from 10 degrees to 70 degrees.

Although the present invention has been explained in relation to the embodiments that a wedge 3 is mounted on an adjustable jaw 2 of an adjustable wrench, it is obvious to those skilled in the art that this invention can be applied in a solid wrench.

The invention claimed is:

1. A single wedge wrench, comprising:

a handle; and a head portion connected to the handle, comprising a stationary jaw, having a zigzag gripping surface;

an adjustable jaw having an inner surface opposite the zigzag gripping surface; and a wedge having a gripping surface, the wedge being slidably connected to the inner surface of the adjustable jaw through a joint member fixed to the inner surface, wherein the wedge has a sliding slot to receive the joint member so that the wedge can slidably move along the adjustable jaw, wherein the sliding slot has a recess at a bottom of the wedge, and a spring is disposed in the recess to connect the joint member, and wherein a plate is provided to close one end of the sliding slot and one end of the recess, an L-shaped groove having an upper portion and a lower portion is formed at one end portion of the fixed joint member, and the plate comprises an upper section embedded into the upper portion of the L-shaped groove, and a lower section embedded into a lower portion of the L-shaped groove.

2. The wrench of claim 1, wherein the joint member is configured in the shape of an inverted trapeziform, and the sliding slot has such a shape that the joint member can slidably move therein.

3. The wrench of claim 1, wherein the joint member is affixed to the inner surface by two screw bolts inserted into two screw holes at the inner surface and two apertures corresponding to the screw holes respectively at the joint member.

4. The wrench of claim 2, wherein the joint member is affixed to the inner surface by two screw bolts inserted into two screw holes at the inner surface and two apertures corresponding to the screw holes respectively at the joint member.

5. The wrench of claim 1, wherein an angle between the inner surface and the gripping surface ranges from 10 degrees to 70 degrees.

* * * * *